US009948022B2

(12) United States Patent
Arai et al.

(10) Patent No.: US 9,948,022 B2
(45) Date of Patent: Apr. 17, 2018

(54) WATERPROOF CONNECTOR

(71) Applicant: JAPAN AVIATION ELECTRONICS INDUSTRY, LIMITED, Tokyo (JP)

(72) Inventors: Katsumi Arai, Tokyo (JP); Hiroshi Akimoto, Tokyo (JP); Fumiki Yamada, Tokyo (JP); Toshiyuki Shimoda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/465,892

(22) Filed: Mar. 22, 2017

(65) Prior Publication Data

US 2017/0194735 A1 Jul. 6, 2017

Related U.S. Application Data

(63) Continuation of application No. PCT/JP2015/067458, filed on Jun. 17, 2015.

(30) Foreign Application Priority Data

Dec. 14, 2017 (JP) ..... 2014-212428

(51) Int. Cl.
*H01R 13/52* (2006.01)
*H01R 13/6587* (2011.01)

(52) U.S. Cl.
CPC ..... *H01R 13/5202* (2013.01); *H01R 13/5213* (2013.01); *H01R 13/6587* (2013.01)

(58) Field of Classification Search
CPC ..... H01R 13/521
See application file for complete search history.

(56) References Cited

U.S. PATENT DOCUMENTS 5,984,724 A * 11/1999 McNeel ..... H01R 13/405 439/281
2013/0183844 A1* 7/2013 Wang ..... H01R 24/68 439/271

FOREIGN PATENT DOCUMENTS

JP 62-121514 U 8/1987
JP 5433776 B1 3/2014

* cited by examiner

*Primary Examiner* — Ross Gushi
(74) *Attorney, Agent, or Firm* — Muncy, Geissler, Olds & Lowe, P.C.

(57) ABSTRACT

A waterproof connector includes a housing made of an insulating resin, and a conductive member formed integrally with the housing, the conductive member having a connector connecting section exposed from the housing, a board connecting section exposed from the housing, and a fixed section connecting embedded in the housing, a waterproof shaped section for blocking entry of water along an interface between the fixed section and the housing being formed at a surface of the fixed section, the waterproof shaped section having a protrusion that protrudes outwardly from the surface of the fixed section and a groove that is adjacent to the protrusion and is dented inwardly from the surface of the fixed section, with a top of the protrusion and a bottom of the groove adjacent to the protrusion being connected by a barrier surface inclined or perpendicular to the surface of the fixed section.

9 Claims, 7 Drawing Sheets

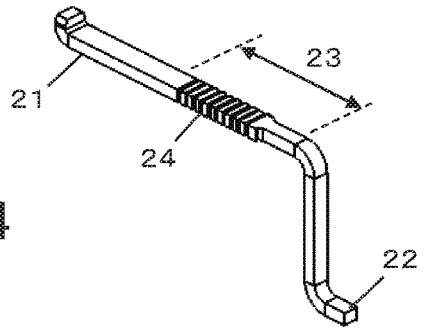
FIG. 4
FIG. 5
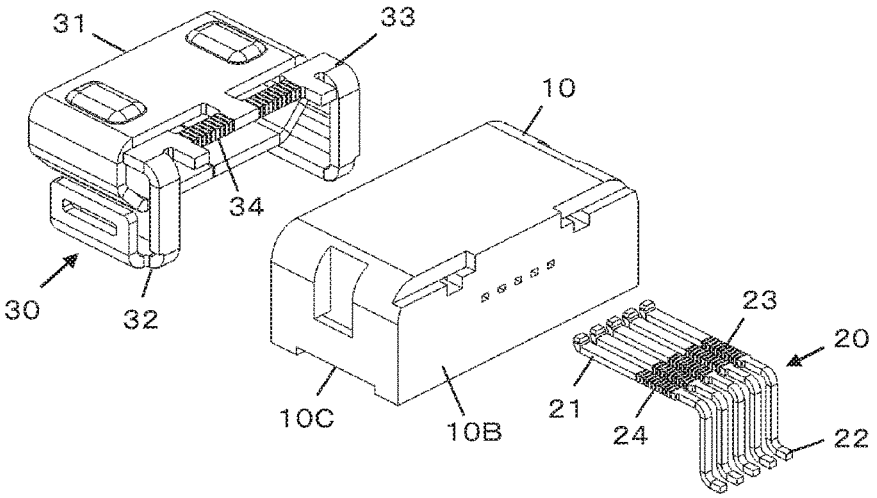
FIG. 6
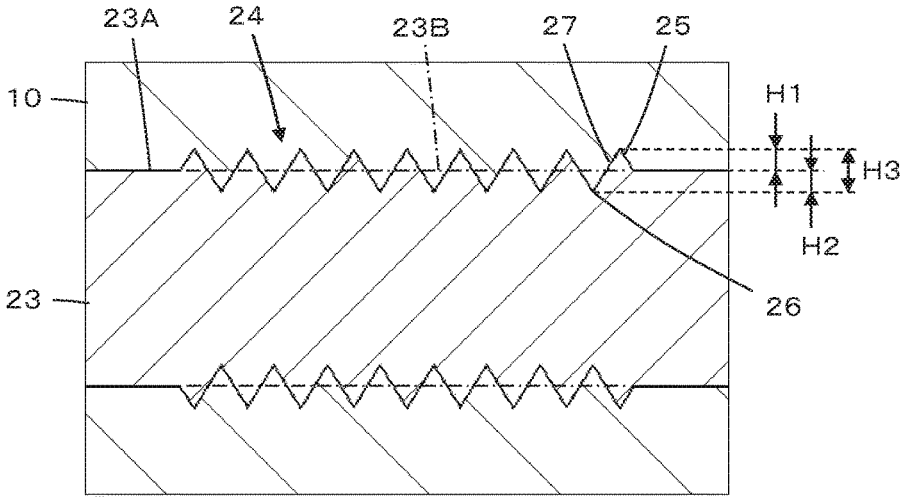

WATERPROOF CONNECTOR

BACKGROUND OF THE INVENTION

The present invention relates to a waterproof connector, particularly to a waterproof connector in which conductive members such as contacts and a shell are formed integrally with a housing made of an insulating resin.

In recent years, there is a strong demand for waterproof function in various electronic devices and accordingly, waterproof connectors having waterproof properties have been under development as connectors for establishing connections with external devices.

One example of such waterproof connectors is a connector in which conductive members such as contacts and a shell are formed inside a housing made of an insulating resin to be integral with the housing by, for example, insert molding. Owing to the integral molding, surfaces of the conductive members tightly adhere to the insulating resin at portions embedded in the housing because of a mold shrinking force of the insulating resin, and water is prevented from penetrating from the outside to the inside of the connector through boundary portions between the housing and the conductive members.

In general, however, a metal material making up the conductive members, such as contacts and a shell, and a resin material making up the housing are different in thermal expansion coefficient from each other, and therefore, when, for example, the connector is exposed to a high temperature environment during a soldering process such as reflow mounting in mounting the connector onto a circuit board of an electronic device, due to the different degree of expansion between the conductive members and the insulating resin, the insulating resin tightly adhering to surfaces of the conductive members may be separated therefrom. Once separated, the surfaces of the conductive members and the insulating resin are to have gaps therebetween, and water may disadvantageously enter the inside of the connector through the gaps even after the temperature falls to ambient temperature.

Aside from that, in a fitting process of a counter connector with the connector, the counter connector may be forcibly fitted in a direction oblique to the fitting axis, which is so-called "ill fitting," and a high stress may be applied between the housing and the conductive members. In this case, again, the insulating resin of the housing may be separated from the surfaces of the conductive members, thereby damaging waterproof properties of the connector.

To cope with it, a waterproof connector in which a waterproof shaped section composed of grooves or protrusions is formed at the portion of a surface of a conductive member to be embedded in a housing to thereby improve waterproof properties, was filed by the present applicant and has been registered (JP 5433776 B).

In the waterproof connector of JP 5433776 B, for instance, as shown in FIG. 15A, a plurality of grooves 3 are formed in a surface of a fixed section of a conductive member 2 embedded and fixed in a housing 1 made of an insulating resin, so as to surround and enclose the periphery of the conductive member 2, or as shown in FIG. 15B, a plurality of protrusions 6 are formed on a surface of a fixed section of a conductive member 5 embedded and fixed in a housing 4 made of an insulating resin, so as to surround and enclose the periphery of the conductive member 5.

Owing to the grooves 3 or the protrusions 6, even if the insulating resin constituting the housing 1 or 4 is separated from the surface of the conductive member 2 or 5 due to the difference between the thermal expansion coefficients of an insulating resin material and a metal material or due to so-called ill fitting, and water penetrates along the interface between the housing 1 or 4 and the conductive member 2 or 5, the penetrating water is blocked by the grooves 3 or the protrusions 6.

The grooves 3 or the protrusions 6 each preferably have a height difference H0 equal to or larger than a predetermined value in order to block the entry of water; however, when the grooves 3 with a large height difference are formed as shown in FIG. 15A, the sectional area of the conductive member 2 is reduced accordingly, which may lead to degradative electric resistance performance and deteriorated strength of the conductive member 2.

When the protrusions 6 with a large height difference are formed as shown in FIG. 15B, the flow of the insulating resin injected into a mold may be hindered during integral molding, leading to low formability of the housing 4.

SUMMARY OF THE INVENTION

The present invention has been made to eliminate the conventional drawbacks described above and is aimed at providing a waterproof connector that can minimize the degradation in electric resistance performance of a conductive member and the deterioration of formability of a housing while improving waterproof properties.

A waterproof connector according to the present invention includes:

a housing made of an insulating resin; and at least one conductive member formed integrally with the housing, wherein the at least one conductive member has a connector connecting section exposed from the housing and connected to a counter connector, a board connecting section exposed from the housing and connected to a board, and a fixed section connecting the connector connecting section and the board connecting section and embedded in the housing, wherein a waterproof shaped section for blocking entry of water along an interface between the fixed section and the housing is formed at a surface of the fixed section, and wherein the waterproof shaped section has a protrusion that protrudes outwardly from the surface of the fixed section and a groove that is adjacent to the protrusion and is dented inwardly from the surface of the fixed section, with a top of the protrusion and a bottom of the groove adjacent to the protrusion being connected by a barrier surface inclined or perpendicular to the surface of the fixed section.

BRIEF DESCRIPTION OF THE DRAWINGS

FIG. 4 is a perspective view showing a contact used in the waterproof connector according to Embodiment 1.

FIG. 5 is an exploded perspective view of the waterproof connector according to Embodiment 1.

FIG. 6 is a partial cross-sectional view showing a fixed section of the contact embedded in a housing of the waterproof connector according to Embodiment 1.

DETAILED DESCRIPTION OF THE INVENTION

Figure 1A:
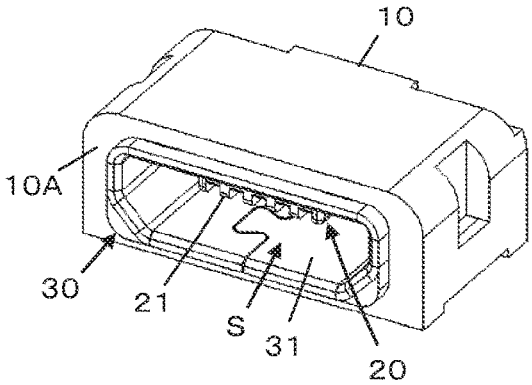
FIGS. 1A to 1D show a waterproof connector according to Embodiment 1 of the invention, FIG. 1A being a perspective view seen from an obliquely upper front position, FIG. 1B being a perspective view seen from an obliquely upper rear position, FIG. 1C being a perspective view seen from an obliquely lower front position, FIG. 1D being a perspective view seen from an obliquely lower rear position.
Figure 1B:
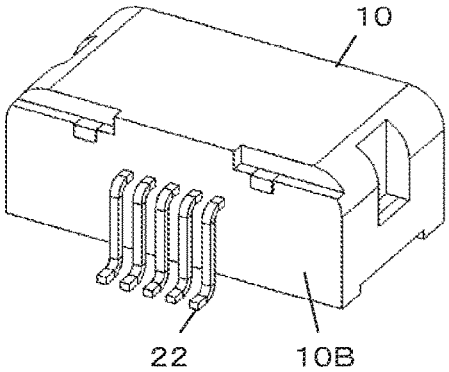
Figure 1C:
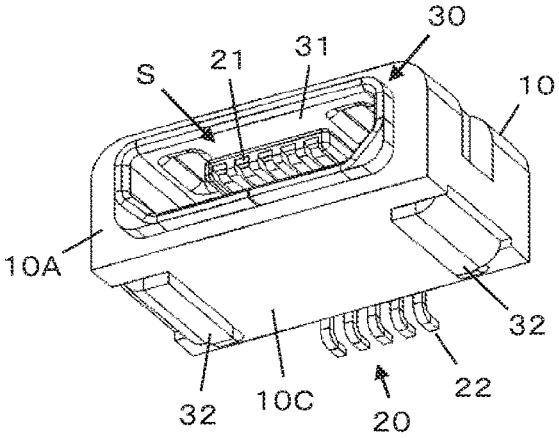
Figure 1D:
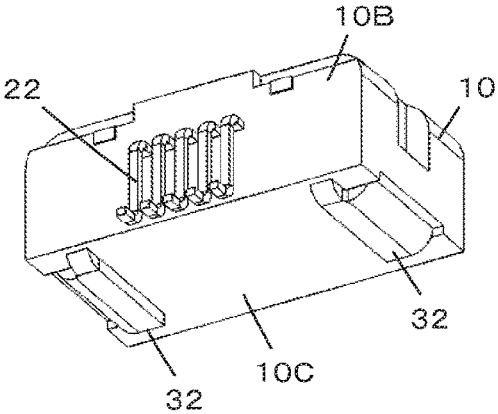
Figure 2A:
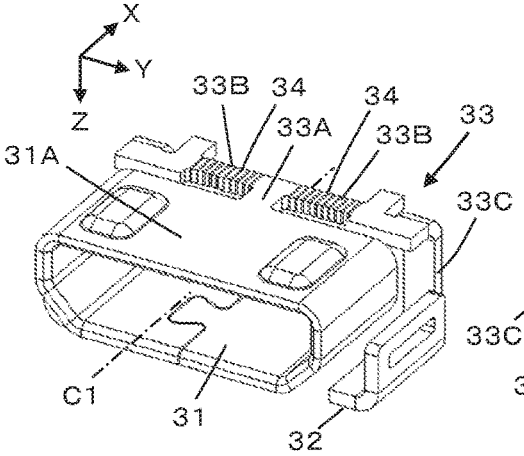
FIGS. 2A to 2D show a shell used in the waterproof connector according to Embodiment 1, FIG. 2A being a perspective view seen from an obliquely upper front position, FIG. 2B being a perspective view seen from an obliquely upper rear position, FIG. 2C being a perspective view seen from an obliquely lower front position, FIG. 2D being a perspective view seen from an obliquely lower rear position.
Figure 2B:
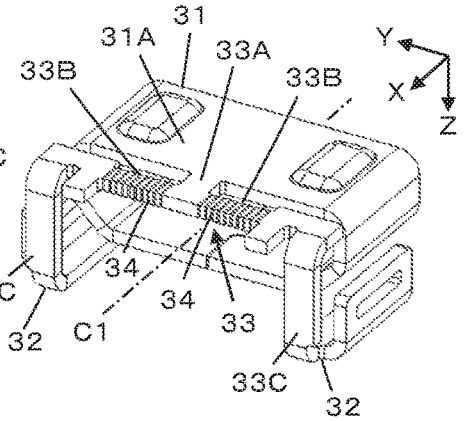
Figure 2C:
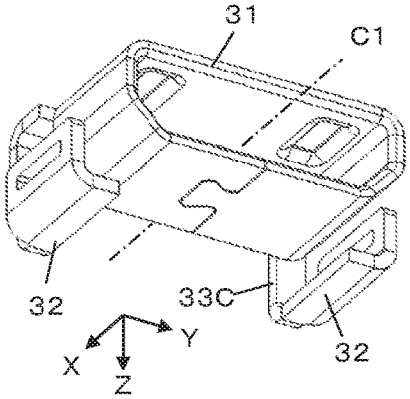
Figure 2D:
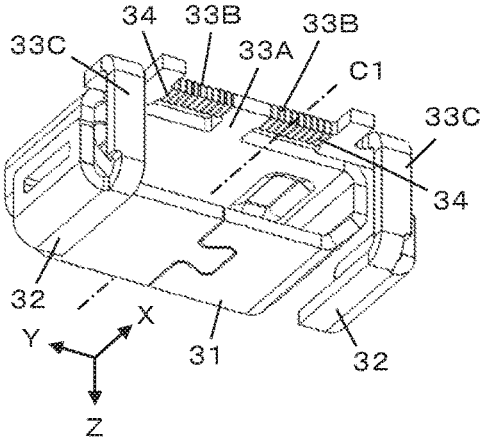

Embodiments of the present invention are described below based on the appended drawings.

Embodiment 1

FIGS. 1A to 1D show the structure of a waterproof connector according to Embodiment 1 of the present invention. The waterproof connector includes a housing 10 having a substantially cuboid outer shape, a plurality of contacts 20 fixed to the housing 10, and a shell 30 fixed to the housing 10 and configured to shield the contacts 20. The housing 10 is made of an insulating resin, and the contacts 20 and the shell 30 are made of a metal material having conductivity.

The shell 30 includes a hollow fitted section (shell-side connector connecting section) 31 that opens at a front surface 10A side of the housing 10. A space S is formed in the fitted section 31 for fitting with a counter connector. A contact section (contact-side connector connecting section) 21 provided at the front end of each contact 20 lies in the space S of the fitted section 31 of the shell 30. On the other hand, a contact-side board connecting section 22 provided at the rear end of each contact 20 is exposed from a rear surface 10B of the housing 10 to the outside of the housing 10.

The shell 30 includes a pair of shell-side board connecting sections 32 that are exposed from a bottom surface 10C of the housing 10 to the outside of the housing 10.

As shown in FIGS. 2A to 2D, the fitted section 31 of the shell 30 has a central axis C1 and has a cylindrical shape whose sectional shape is flat and elongated in a direction perpendicular to the central axis C1. For ease of understanding, a direction extending from front to rear of the fitted section 31 in parallel to the central axis C1 is called "X direction," a plane along which a top surface 31A of the flat fitted section 31 extends "XY plane," and a direction perpendicular to the top surface 31A of the fitted section 31 and extending downward "Z direction."

The shell 30 includes a shell-side fixed section 33 connecting the fitted section 31 and the pair of shell-side board connecting sections 32. The shell-side fixed section 33 includes a rearward projecting section 33A that projects in the X direction from the middle of the upper rear end of the fitted section 31 along the central axis C1 of the fitted section 31, a pair of arm sections 33B that separately extend from the rear end of the rearward projecting section 33A in directions parallel to the top surface 31A of the flat fitted section 31 and perpendicular to the central axis C1, namely, in the Y and −Y directions, and a pair of leg sections 33C that separately extend downward, namely, in the Z direction from the tip ends of the arm sections 33B. The lower ends of the pair of leg sections 33C are separately connected to the shell-side board connecting sections 32. The pair of shell-side board connecting sections 32 are formed to extend from rear to front of the fitted section 31, i.e., in an XY plane and in the −X direction.

The rearward projecting section 33A, the pair of arm sections 33B and the pair of leg sections 33C of the shell-side fixed section 33 form a shell narrow section that is narrower than the fitted section 31. The shell-side fixed section 33 having the shell narrow section is embedded in the housing 10 when the housing 10 is formed by molding together with the shell 30.

A shell-side waterproof shaped section 34 is formed around the outer peripheral surface of each of the pair of arm sections 33B to block the entry of water along the interface between the arm section 33B and the housing 10. The shell-side waterproof shaped section 34 is formed so as to surround and enclose the periphery of the arm section 33B. A surface of the shell-side fixed section 33 is divided by the shell-side waterproof shaped section 34 into a portion containing the fitted section 31 and a portion containing the shell-side board connecting sections 32.

Figure 3:
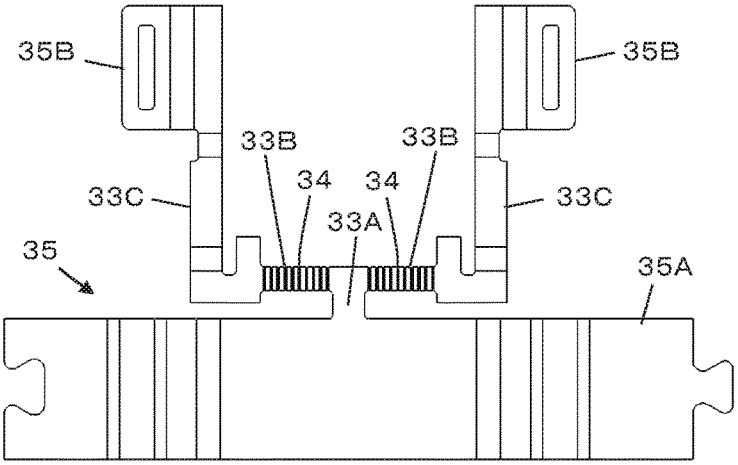
FIG. 3 is a development view showing the shell used in the waterproof connector according to Embodiment 1.

The shell 30 configured as above can be produced by cutting out a metal sheet 35 having conductivity into the shape shown in FIG. 3 and then bending the cut metal sheet by a press or the like. A band portion 35A is shaped into a flat cylindrical shape to form the fitted section 31, the rearward projecting section 33A projects from the middle of the outer edge of the band portion 35A, the pair of arm sections 33B are connected to the tip end of the rearward projecting section 33A, the pair of leg sections 33C are separately connected to the tip ends of the pair of arm sections 33B, and flat plate portions 35B separately connected to the tip ends of the pair of leg sections 33C form the shell-side board connecting sections 32.

As is evident from the development view of FIG. 3, the arm sections 33B having the shell-side waterproof shaped sections 34 are separately provided on the paths from the band portion 35A forming the fitted section 31 to the pair of flat plate portions 35B forming the shell-side board connecting sections 32.

FIG. 4 shows the structure of the contact 20. The contact 20 is formed of a bar-shaped member or a flat plate member. A contact-side fixed section 23 is formed between the contact section 21 and the contact-side board connecting section 22. The contact-side fixed section 23 is a portion to be embedded in the housing 10 to fix the contact 20 to the housing 10 when the housing 10 is formed by molding together with the shell 30. A contact-side waterproof shaped section 24 is formed around the outer peripheral surface of the contact-side fixed section 23 to block the entry of water along the interface between the contact-side fixed section 23 and the housing 10. The contact-side waterproof shaped section 24 is formed so as to surround and enclose the periphery of the contact-side fixed section 23. The surface of the contact 20 is divided by the contact-side waterproof shaped section 24 into a portion containing the contact section 21 and a portion containing the contact-side board connecting section 22.

FIG. 5 shows an exploded view of the waterproof connector. The housing 10 is formed integrally with the shell 30 and the contacts 20 by molding so that the inner surface of the fitted section 31 of the shell 30 is exposed at the front end of the housing 10, the shell-side fixed section 33 at which the shell-side waterproof shaped sections 34 are formed is embedded in the housing 10, the shell-side board connecting sections 32 are exposed from the bottom surface 10C of the housing 10, the contact sections 21 of the contacts 20 are exposed inside the fitted section 31 of the shell 30, the contact-side fixed sections 23 at which the contact-side waterproof shaped sections 24 are formed are embedded in the housing 10, and the contact-side board connecting sections 22 are exposed from the rear surface 10B of the housing 10.

In this case, the contacts 20 and the shell 30 are set in a mold (not shown) so that the contact sections 21 of the contacts 20 are positioned inside the fitted section 31 of the shell 30, the mold is closed, and a molten insulating resin material is injected into the mold and cooled, whereby the housing 10 is formed integrally with the contacts 20 and the shell 30. The waterproof connector shown in FIGS. 1A to 1D can be thus manufactured.

The contact-side waterproof shaped section 24 formed around the outer peripheral surface of the contact-side fixed section 23 is shown in FIG. 6.

The contact-side waterproof shaped section 24 has a plurality of protrusions 25 and a plurality of grooves 26 formed on and in a surface of the contact-side fixed section 23. The protrusions 25 each have a triangular sectional shape and protrude outwardly from a surface 23A of the contact-side fixed section 23 to a height H1 from the surface 23A of the place where the contact-side waterproof shaped section 24 is not present. The grooves 26 are so-called V-grooves each having a triangular sectional shape. Each of the grooves 26 is dented inwardly from the surface 23A of the contact-side fixed section 23 to a depth H2 from the surface 23A of the place where the contact-side waterproof shaped section 24 is not present. In FIG. 6, an extension line 23B of the surface 23A of the contact-side fixed section 23 of the place where the contact-side waterproof shaped section 24 is not present is drawn by dot-and-dash line.

The protrusions 25 and the grooves 26 are alternately arranged in the longitudinal direction of the contact-side fixed section 23, and the top of each protrusion 25 and the bottom of the adjacent groove 26 are connected by a planar barrier surface 27 that is straightly inclined to the surface 23A of the contact-side fixed section 23.

The barrier surfaces 27 are formed in a corresponding manner to the protrusions 25 and the grooves 26. Each of the barrier surfaces 27 has a height difference H3 expressed by H1+H2, i.e., the sum of the height H1 of the protrusion 25 and the depth H2 of the groove 26. The height difference H3 is preferably not less than 0.01 mm in order to block the entry of water along the interface between the contact-side fixed section 23 and the housing 10.

The protrusions 25 and the grooves 26 are formed so as to surround and enclose the periphery of the contact-side fixed section 23.

The contact-side waterproof shaped section 24 thus configured can be formed by mechanical processing such as laser processing, stamping and grinding, or chemical processing such as etching.

The above configuration of the contact-side waterproof shaped section 24 makes it possible to ensure the height difference of H3=H1+H2 required of the barrier surfaces 27 to block the entry of water, while keeping the amount of protrusion of the tops of the protrusions 25 to H1 and the amount of dent of the bottoms of the grooves 26 to H2 from the surface 23A of the contact-side fixed section 23 of the place where the contact-side waterproof shaped section 24 is not present.

Therefore, the decrease in sectional area of the contact-side fixed section 23 due to the provision of the grooves 26 is minimized, and accordingly, the degradation in electric resistance performance and the deterioration of mechanical strength of the contacts 20 can be minimized.

In addition, the amount of protrusion of the tops of the protrusions 25 is kept to H1, i.e., a value smaller than the height difference H3 required to block the entry of water, and this makes it possible to minimize the deterioration of formability of the housing 10 caused by the decrease in fluidity of insulating resin injected into a mold in integral molding of the housing 10 and the contacts 20. In addition, since the decrease in thickness of the housing 10 because of the protrusions 25 is minimized and the decrease in mold shrinking force of the insulating resin constituting the housing 10 is minimized, the adhesion between the housing 10 and the contact-side fixed section 23 can be ensured.

Furthermore, the amount of protrusion of the tops of the protrusions 25 is suppressed, which allows high-speed transmission of electrical signals to be carried out.

Similarly to the contact-side waterproof shaped section 24, the shell-side waterproof shaped sections 34 formed around the outer peripheral surfaces of the arm sections 33B of the shell-side fixed section 23 each include a plurality of protrusions that protrude outwardly from a surface of the arm section 33B of the place where the shell-side waterproof shaped section 34 is not present and a plurality of grooves that are dented inwardly from the surface of the arm section 33B of the place where the shell-side waterproof shaped section 34 is not present, and the top of each protrusion and the bottom of the adjacent groove are connected by a barrier surface that is straightly inclined to the surface of the arm section 33B.

Thus, as with the contacts 20, the configuration of the shell 30 makes it possible to ensure a height difference required of the barrier surfaces to block the entry of water while minimizing the degradation in electric resistance performance and the deterioration of mechanical strength of the shell 30, to minimize the deterioration of formability of the housing 10, and to ensure the adhesion between the housing 10 and the arm sections 33B of the shell-side fixed section 33.

Figure 7:
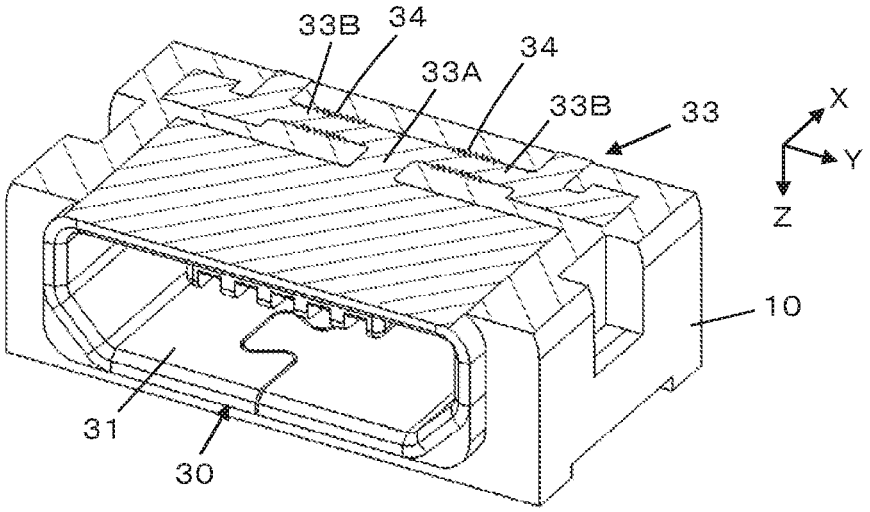
FIG. 7 is a perspective view showing the waterproof connector according to Embodiment 1 cut at the height at which a shell waterproof shaped section lies.

FIG. 7 shows the waterproof connector according to Embodiment 1 cut along an XY plane at the height at which the pair of arm sections 33B of the shell 30 lie. The shell-side fixed section 33 of the shell 30 is embedded in the housing 10, and the pair of arm sections 33B are connected to the fitted section 31 via the rearward projecting section 33A. The inner surface of the fitted section 31 is not covered by the housing 10 but is exposed. The shell-side waterproof shaped sections 34 are formed at the arm sections 33B so as to surround and enclose the peripheries of the arm sections 33B. The sectional shapes of the shell-side waterproof shaped sections 34 appear at both lateral edges of the cross sections of the arm sections 33B.

Figure 8:
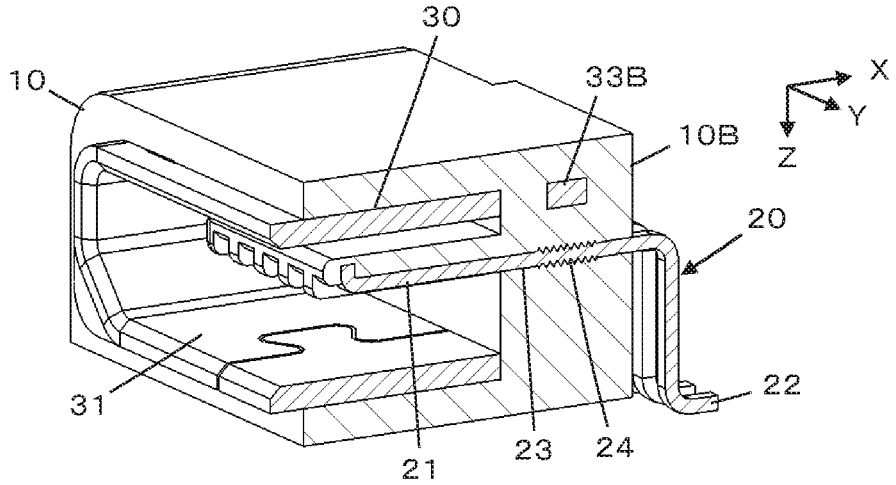
FIG. 8 is a perspective view showing the waterproof connector according to Embodiment 1 cut at the position where one contact lies.

FIG. 8 shows the waterproof connector cut along an XZ plane at the position where one contact 20 lies. The contact section 21 of each contact 20 is exposed inside the fitted section 31 of the shell 30, the contact-side board connecting section 22 projects and is exposed rearward from the rear surface 10B of the housing 10, and the contact-side fixed section 23 is embedded in the housing 10. A cross section of the arm section 33B of the shell 30 is seen above the contact-side fixed section 23 of the contact 20. The contact-side waterproof shaped section 24 is formed at the contact-side fixed section 23 of the contact 20 so as to surround and enclose the periphery of the contact-side fixed section 23, and the sectional shape of the contact-side waterproof shaped section 24 appears at both lateral edges of the cross section of the contact-side fixed section 23.

Owing to the integral molding of the housing 10 with the shell 30 and the contacts 20, the insulating resin constituting the housing 10 tightly adheres to surfaces of the shell-side fixed section 33 of the shell 30 and surfaces of the contact-side fixed sections 23 of the contacts 20 as embedded in the housing 10.

As described above, the contact-side waterproof shaped sections 24 are formed at the contact-side fixed sections 23 of the contacts 20 to be embedded in the housing 10 so as to surround and enclose the peripheries of the contact-side fixed sections 23. With this configuration, even if the insulating resin of the housing 10 tightly adhering to the surfaces of the contact-side fixed sections 23 of the contacts 20 is separated from any of the contact-side fixed sections 23 and water penetrates along the contact section 21 exposed to the inside of the fitted section 31 of the shell 30 and then along the interface between the contact-side fixed section 23 and the housing 10, the penetrating water is blocked by the contact-side waterproof shaped section 24 and prevented from reaching the contact-side board connecting section 22 exposed from the rear surface 10B of the housing 10.

Likewise, the shell-side waterproof shaped sections 34 are formed at the shell-side fixed section 33 of the shell 30 to be embedded in the housing 10 so as to surround and enclose the peripheries of the arm sections 33B provided on the paths from the fitted section 31 to the shell-side board connecting sections 32. Therefore, even if the insulating resin of the housing 10 tightly adhering to the surfaces of the shell-side fixed section 33 of the shell 30 is separated from the shell-side fixed section 33 due to, for instance, the difference between the thermal expansion coefficients of the insulating resin material constituting the housing 10 and the metal material constituting the shell 30 or due to so-called ill fitting in which the waterproof connector is forcibly fitted in a direction oblique to the fitting axis during fitting with a counter connector, and water penetrates from the fitted section 31 and along the interface between the shell-side fixed section 33 and the housing 10, the penetrating water is blocked by the shell-side waterproof shaped section 34 as soon as reaching the arm section 33B of the shell-side fixed section 33 and is prevented from reaching the shell-side board connecting section 32 exposed from the bottom surface 10C of the housing 10.

In particular, the arm sections 33B at which the shell-side waterproof shaped sections 34 are formed are constituent portions of the shell narrow section that is narrower than the fitted section 31, and accordingly, the entry path of water is so narrow as to limit the amount of penetrating water. Therefore, owing to the shell-side waterproof shaped sections 34, the waterproof function can work more effectively.

The waterproof properties between the housing 10 and the shell 30 and contacts 20 are thus improved so that water can be prevented from penetrating to the interior of a device, i.e., to the side at which a board having mounted thereon the waterproof connector is placed.

Although the contact-side waterproof shaped section 24 shown in FIG. 6 has the plurality of protrusions 25, the plurality of grooves 26 and the plurality of barrier surfaces 27, the invention is not limited thereto. A contact-side waterproof shaped section only with a single protrusion 25, a single groove 26 and a single barrier surface 27 can still minimize the entry of water along the interface with the housing 10. The provision of the pluralities of protrusions 25, grooves 26 and barrier surfaces 27, however, leads to more excellent waterproof function.

Similarly, while the shell-side waterproof shaped section 34 can be composed of a single protrusion, a single groove, and a single barrier surface connecting the protrusion and the groove, the provision of the pluralities of protrusions, grooves and barrier surfaces leads to more excellent waterproof effect.

In place of the pair of shell-side board connecting sections 32 exposed from the bottom surface 10C of the housing 10, the shell 30 may have a single shell-side board connecting section 32 or three or more shell-side board connecting sections 32. When a single shell-side board connecting section 32 is provided, the configuration may be applied in which a single arm section 33B is formed on the path from the fitted section 31 to the shell-side board connecting section 32 and the shell-side waterproof shaped section 34 is formed at the surface of the arm section 33B. When the shell 30 has three or more shell-side board connecting sections 32, one or more shell-side waterproof shaped sections 34 may be provided on any of the paths from the fitted section 31 to the respective shell-side board connecting sections 32, and the number of arm sections 33B at which the shell-side waterproof shaped sections 34 are formed may be equal to or smaller than the number of the shell-side board connecting sections 32.

While the fitted section 31 of the shell 30 has a flat cylindrical shape so as to cover the entire surrounding of the contact sections 21 of the contacts 20, the invention is not limited thereto. The fitted section 31 covering merely a part of the contact sections 21 of the contacts 20 can still bring about a shielding effect depending on the usage of the waterproof connector. When such a shielding effect is not required and a shell is used for the purpose of attaching the waterproof connector to a board via the shell-side board connecting section(s) 32, the shell need not cover the contact sections 21 of the contacts 20.

Embodiment 2

In the contact-side waterproof shaped section 24 used in Embodiment 1 above, as shown in FIG. 6, the protrusions 25 and the grooves 26 each have a triangular sectional shape, and each of the barrier surfaces 27 which connects the top of each protrusion 25 and the bottom of the adjacent groove 26 has a planar shape; however, the invention is not limited thereto.

Figure 9A:
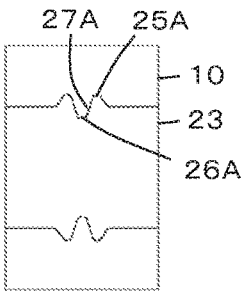
FIGS. 9A to 9O are partial cross-sectional views showing various waterproof shaped sections of contacts each used in a waterproof connector according to Embodiment 2.
Figure 9B:
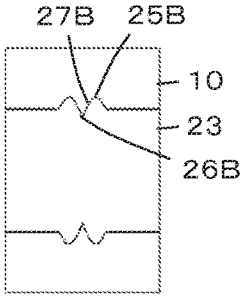

For example, as shown in FIG. 9A, a rounded protrusion 25A composed of a curved surface and a rounded groove 26A composed of a curved surface may be formed. In this case, a barrier surface 27A connecting the top of the protrusion 25A and the bottom of the groove 26A is to be a combination of a flat surface and a curved surface. Aside from that, as shown in FIG. 9B, a rounded protrusion 25B composed of a curved surface and a triangular groove 26B may be combined.

Figure 9C:
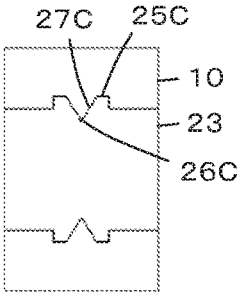
Figure 9D:
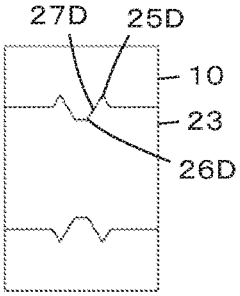
Figure 9E:
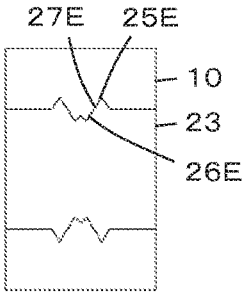
Figure 9F:
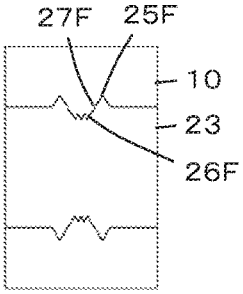
Figure 9G:
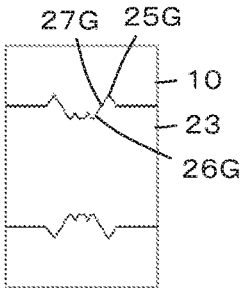

As shown in FIG. 9C, a protrusion 25C with a flat top and a triangular groove 26C may be combined. Conversely, as shown in FIG. 9D, a triangular protrusion 25D and a groove 26D with a flat bottom may be combined. Further possible combinations include the combination of a groove 26E with a flat bottom on which one triangular micro projection is formed and a triangular protrusion 25E as shown in FIG. 9E, the combination of a groove 26F with a flat bottom on which two triangular micro projections are continuously formed and a triangular protrusion 25F as shown in FIG. 9F, the combination of a groove 26G with a flat bottom on which two triangular micro projections are formed at a distance from each other and a triangular protrusion 25G as shown in FIG. 9G.

Figure 9H:
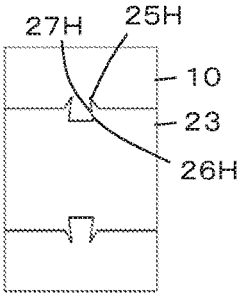

While in each of the contact-side waterproof shaped sections 24 shown in FIGS. 9A to 9G, a pair of barrier surfaces 27A to 27G formed on both sides of a groove 26A to 26G takes on a taper shape that is tapered toward the inner portion of the contact-side fixed section 23, as shown in FIG. 9H, a groove 26H with a flat bottom may be formed between a pair of sharply pointed protrusions 25H so that a pair of barrier surfaces 27H formed on both sides of the groove 26H takes on a taper shape that is tapered toward the outside of the contact-side fixed section 23.

Figure 9I:
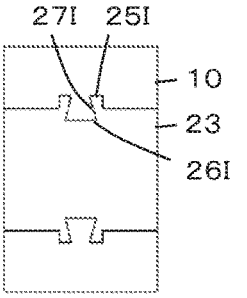

Likewise, as shown in FIG. 9I, a groove 26I with a flat bottom may be formed between a pair of protrusions 25I with flat tops, and a pair of barrier surfaces 27I formed on both sides of the groove 26I may take on a taper shape that is tapered toward the outside of the contact-side fixed section 23.

Figure 9J:
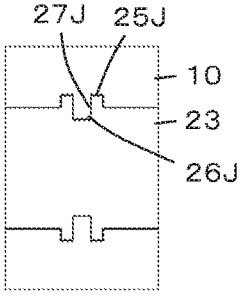

While in each of the contact-side waterproof shaped sections 24 shown in FIGS. 9A to 9I, barrier surfaces 27A to 27I are inclined to the surface of the contact-side fixed section 23, as shown in FIG. 9J, a flat top of a protrusion 25J and a flat bottom of a groove 26J may be connected by a barrier surface 27J perpendicular to the surface of the contact-side fixed section 23. The use of the contact-side waterproof shaped section 24 having the thus-configured barrier surface 27J also makes it possible to minimize the entry of water along the interface between the housing 10 and the contact-side fixed section 23, thus achieving an excellent waterproof effect.

Figure 9K:
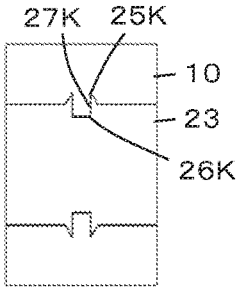
Figure 9L:
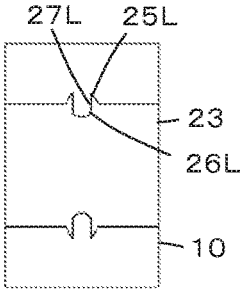

As shown in FIG. 9K, the top of a triangular protrusion 25K and the bottom of a flat groove 26K may be connected by a barrier surface 27K perpendicular to the surface of the contact-side fixed section 23. Aside from that, as shown in FIG. 9L, the top of a triangular protrusion 25L and the bottom of a U-shaped groove 26L may be connected by a barrier surface 27L. In this case, the barrier surface 27L is to be a combination of a flat surface perpendicular to the surface of the contact-side fixed section 23 and a curved surface.

Figure 9M:
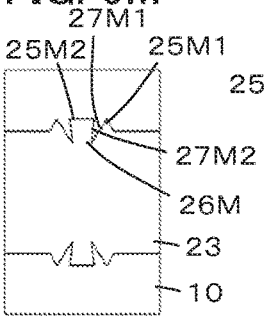

As shown in FIG. 9M, a protrusion 25M2 with a flat top may be formed between a pair of triangular protrusions 25M1 with a triangular groove 26M being formed between each of the protrusions 25M1 on both sides and the middle protrusion 25M2. The top of the protrusion 25M1 and the bottom of the groove 26M are connected by a barrier surface 27M1, and the top of the protrusion 25M2 and the bottom of the groove 26M are connected by a barrier surface 27M2, with the barrier surfaces 27M1 and 27M2 differing from each other in inclination angle.

Each of the contact-side waterproof shaped sections 24 shown in FIGS. 9A to 9M has a sectional shape symmetrical with respect to a plane perpendicular to the longitudinal direction of the contact-side fixed section 23 but may have an asymmetrical sectional shape.

Figure 9N:
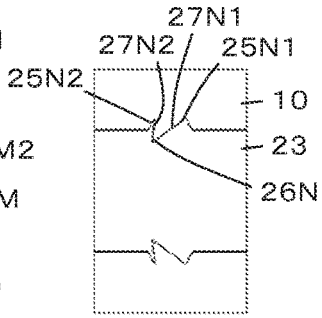

For instance, as shown in FIG. 9N, a triangular groove 26N may be formed between a triangular protrusion 25N1 with a relatively large vertex angle and a triangular protrusion 25N2 with a relatively small vertex angle. Since the protrusions 25N1 and 25N2 are different from each other in vertex angle, a barrier surface 27N1 connecting the top of the protrusion 25N1 and the bottom of the groove 26N is different in inclination angle from a barrier surface 27N2 connecting the top of the protrusion 25N2 and the bottom of the groove 26N.

Figure 9O:
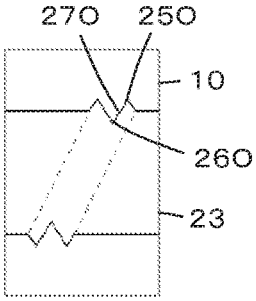

While each of the contact-side waterproof shaped sections 24 shown in FIGS. 9A to 9N is formed so as to surround and enclose the periphery of the contact-side fixed section 23 in a plane perpendicular to the longitudinal direction of the contact-side fixed section 23, as shown in FIG. 9O, a protrusion 25O, a groove 26O and a barrier surface 27O may be formed so as to surround and enclose the periphery of the contact-side fixed section 23 in a plane inclined to the longitudinal direction of the contact-side fixed section 23. With this configuration, a part of the groove 26O formed in the top surface of the contact-side fixed section 23 and another part of the groove 26O formed in the bottom surface of the contact-side fixed section 23 are offset from each other in the longitudinal direction of the contact-side fixed section 23. Thus, the decrease in sectional area of the contact-side fixed section 23 due to the provision of the groove 26O is efficiently minimized, which is advantageous in minimizing the degradation in electric resistance performance and the deterioration of mechanical strength of the contacts 20.

FIGS. 9A to 9O show basic configurations involving the configuration in which a pair of barrier surfaces 27A to 27L, 27N1 and 27N2, and 27O are formed on both sides of a groove 26A to 26L, 26N and 26O and the configuration in which the pair of barrier surfaces 27M1 and 27M2 are formed on both sides of each of the pair of grooves 26M. When a plurality of protrusions 25A to 25L, 25M1, 25M2, 25N1, 25N2, and 25O and a plurality of grooves 26A to 26O are continuously formed on the surface of the contact-side fixed section 23 so that a plurality of barrier surfaces 27A to 27L, 27M1, 27M2, 27N1, 27N2, and 27O are formed, a more excellent waterproof effect can be obtained.

The sectional configuration of the contact-side waterproof shaped section in the present invention is not limited to those shown in FIG. 6 and FIGS. 9A to 9O, and the contact-side waterproof shaped section may have any sectional configuration as long as it has a protrusion that protrudes outwardly from the surface of the contact-side fixed section and a groove that is adjacent to this protrusion and is dented inwardly from the surface of the contact-side fixed section with the top of the protrusion and the bottom of the adjacent groove being connected by a barrier surface inclined or perpendicular to the surface of the contact-side fixed section 23.

The shell-side waterproof shaped section 34 in Embodiment 1 can also employ a configuration similar to any of the configurations of the contact-side waterproof shaped sections 24 shown in FIGS. 9A to 9O.

Embodiment 3

While the shell-side waterproof shaped section 34 is formed at the arm section 33B of the shell-side fixed section 33 in the shell 30 in Embodiment 1 above, the place to be formed is not limited to the arm section 33B but may be anywhere as long as it is a narrow section of the shell-side fixed section 33 that is to be embedded in the housing 10 and is provided on the path from the fitted section 31 to the shell-side board connecting section 32.

Figure 10:
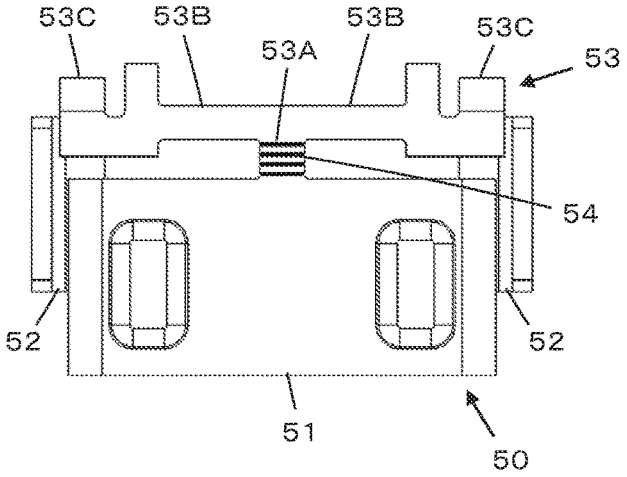
FIG. 10 is a plan view showing a shell used in a waterproof connector according to Embodiment 3.

For instance, as in a shell 50 shown in FIG. 10, a shell-side waterproof shaped section 54 may be formed at a surface of a rearward projecting section 53A that projects rearward from the rear end of a fitted section 51. The shell-side waterproof shaped section 54 is configured similarly to the contact-side waterproof shaped section 24 shown in FIG. 6 and the shell-side waterproof shaped section 34 in Embodiment 1. The shell 50 has the same configuration as that of the shell 30 used in Embodiment 1 except that the shell-side waterproof shaped section 54 is formed at the rearward projecting section 53A. Specifically, a shell-side fixed section 53 is positioned between the fitted section 51 and a pair of shell-side board connecting sections 52; the shell-side fixed section 53 includes the rearward projecting section 53A, a pair of arm sections 53B connected to the rear end of the rearward projecting section 53A, and a pair of leg sections 53C connected to the tip ends of the arm sections 53B; and the tip ends of the leg sections 53C are connected to the corresponding shell-side board connecting sections 52.

To reach from the fitted section 51 to the shell-side board connecting sections 52 along surfaces of the shell 50, it is necessary to pass the rearward projecting section 53A. Therefore, by forming the shell-side waterproof shaped section 54 around the outer peripheral surface of the rearward projecting section 53A, the entry of water along the interface between the fixed section 53 and the housing 10 can be blocked.

Instead of the rearward projecting section 53A, the shell-side waterproof shaped sections 54 may be formed at surfaces of the pair of leg sections 53C in the same manner.

Thus, Embodiment 3 also makes it possible to minimize the degradation in electric resistance performance of the contacts 20 and the shell 50 and the deterioration of formability of the housing 10 while improving waterproof properties.

Embodiment 4

In the shells 30 and 50 used in Embodiments 1 and 3 above, the shell-side waterproof shaped sections 34 and 54 are respectively formed at the arm sections 33B and the rearward projecting section 53A, which are the narrow sections, but are not necessarily formed at such a narrow section.

Figure 11:
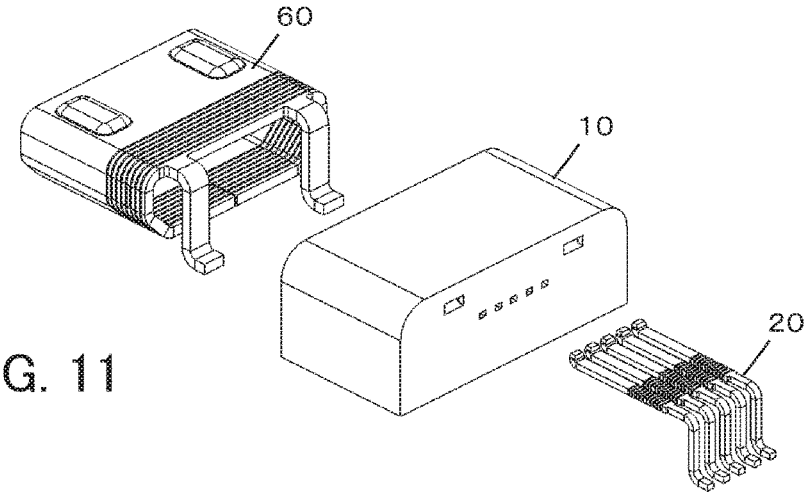
FIG. 11 is an exploded perspective view of a waterproof connector according to Embodiment 4.

FIG. 11 shows an exploded perspective view of a waterproof connector according to Embodiment 4. In this waterproof connector, a shell 60 with no narrow section is used in the waterproof connector of Embodiment 1 in place of the shell 30.

Figure 12:
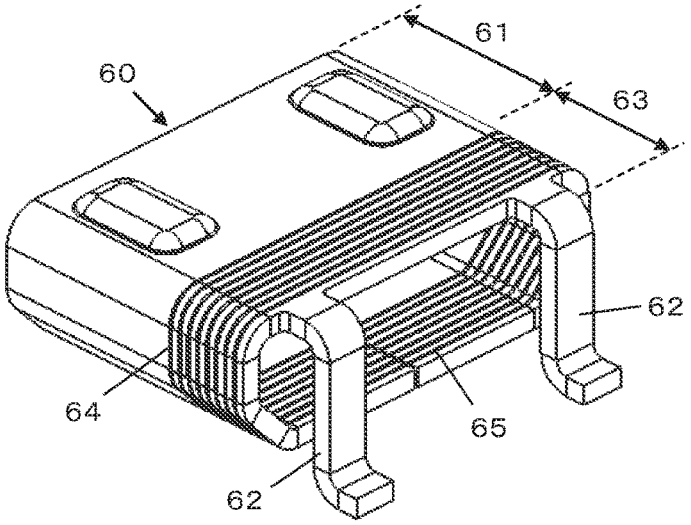
FIG. 12 is a perspective view showing a shell used in the waterproof connector according to Embodiment 4.

As shown in FIG. 12, the shell 60 has a hollow fitted section 61 in a flat cylindrical shape and a hollow shell-side fixed section 63 in a flat cylindrical shape connected to the rear end of the fitted section 61. A pair of shell-side board connecting sections 62 are formed to project from the rear end of the shell-side fixed section 63. In other words, one cylindrical body is divided into a front end portion and a rear end portion with the front end portion being defined as the fitted section 61 and the rear end portion being defined as the shell-side fixed section 63.

The fitted section 61 covers the surrounding of the contact sections 21 provided at the front ends of the contacts 20 with its inner surface portion being exposed from the housing 10. The inner and outer surface portions of the shell-side fixed section 63 are fully embedded in the housing 10.

A shell-side waterproof shaped section 64 is formed at the outer peripheral surface of the shell-side fixed section 63, while a shell-side waterproof shaped section 65 is also formed at the inner peripheral surface of the shell-side fixed section 63. The shell-side waterproof shaped section 64 is formed so as to surround and enclose the outer periphery of the shell-side fixed section 63, while the shell-side waterproof shaped section 65 is formed so as to surround and enclose the inner periphery of the shell-side fixed section 63. The shell-side waterproof shaped sections 64 and 65 each have a configuration similar to those of the contact-side waterproof shaped section 24 shown in FIG. 6 and the shell-side waterproof shaped section 34 in Embodiment 1 and that of the shell-side waterproof shaped section 54 in Embodiment 2.

To reach from the fitted section 61 to the shell-side board connecting sections 62 along surfaces of the shell 60, it is necessary to go across the shell-side waterproof shaped section 64 or 65. Thus, owing to the shell-side waterproof shaped sections 64 and 65, the entry of water along the interface between the shell-side fixed section 63 and the housing 10 can be blocked.

Figure 13:
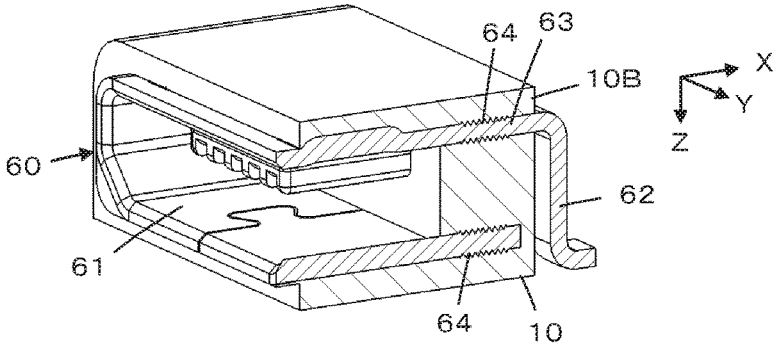
FIG. 13 is a perspective view showing the waterproof connector according to Embodiment 4 cut at the position where a board connecting section of the shell lies.

FIG. 13 shows the waterproof connector according to Embodiment 4 cut along an XZ plane at the position where one shell-side board connecting section 62 lies. The inner surface of the fitted section 61 of the shell 60 is not covered by the housing 10 but is exposed, the shell-side fixed section 63 is embedded in the housing 10, and the shell-side board connecting sections 62 connected to the rear end of the shell-side fixed section 63 project and are exposed from the rear surface 10B of the housing 10. The shell-side waterproof shaped sections 64 and 65 are formed at the outer and inner peripheral surfaces of the shell-side fixed section 63, respectively, and therefore the sectional shapes of the shell-side waterproof shaped sections 64 and 65 appear at both lateral edges of the cross section of the shell-side fixed section 63.

Figure 14:
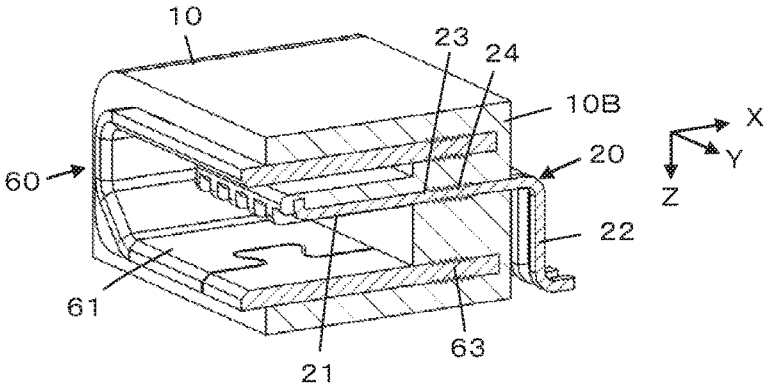
FIG. 14 is a perspective view showing the waterproof connector according to Embodiment 4 cut at the position where one contact lies.
Figure 15A:
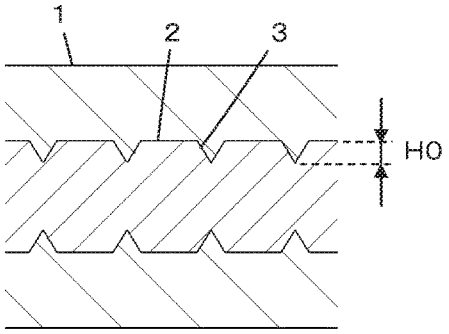
FIG. 15A PRIOR ART
FIGS. 15A and 15B show fixed sections of conductive members each embedded in a housing of a conventional waterproof connector, FIG. 15A being a partial cross-sectional view of a fixed section having a surface in which grooves are formed, FIG. 15B being a partial cross-sectional view of a fixed section having a surface on which protrusions are formed.
Figure 15B:
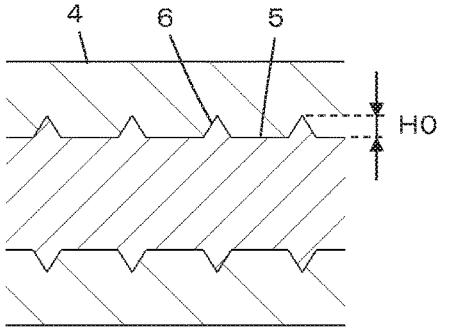
FIG. 15B PRIOR ART

FIG. 14 shows the waterproof connector cut along an XZ plane at the position where one contact 20 lies. The contact section 21 of each contact 20 is exposed inside the fitted section 61 of the shell 60, the contact-side board connecting section 22 projects and is exposed rearward from the rear surface 10B of the housing 10, and the contact-side fixed section 23 is embedded in the housing 10. The contact-side waterproof shaped sections 24 are formed at the contact-side fixed section 23 of the contact 20 so as to surround and enclose the periphery of the contact-side fixed section 23. Accordingly, the sectional shape of the contact-side waterproof shaped section 24 appears at both lateral edges of the cross section of the contact-side fixed section 23.

Thus, with the shell 60 having the hollow shell-side fixed section 63, it is also possible to achieve an excellent waterproof effect between the housing 10 and the shell 60 or the contacts 20 and to minimize the degradation in electric resistance performance of the contacts 20 and the shell 60 and the deterioration of formability of the housing 10.

It should be noted that the shell-side waterproof shaped section 54 in Embodiment 3 and the shell-side waterproof shaped sections 64 and 65 in Embodiment 4 can employ a configuration similar to any of the configurations of the contact-side waterproof shaped sections 24 shown in FIGS. 9A to 9O.

What is claimed is:

1. A waterproof connector comprising:

a housing made of an insulating resin; and at least one conductive member formed integrally with the housing, wherein the at least one conductive member has a connector connecting section exposed from the housing and connected to a counter connector, a board connecting section exposed from the housing and connected to a board, and a fixed section connecting the connector connecting section and the board connecting section and embedded in the housing, wherein a waterproof shaped section for blocking entry of water along an interface between the fixed section and the housing is formed at a surface of the fixed section, wherein the waterproof shaped section has a protrusion that protrudes outwardly from the surface of the fixed section and a groove that is adjacent to the protrusion and is dented inwardly from the surface of the fixed section, with a top of the protrusion and a bottom of the groove adjacent to the protrusion being connected by a barrier surface inclined or perpendicular to the surface of the fixed section, and wherein each of the protrusion and the groove is formed so as to surround and enclose a periphery of the fixed section in a plane inclined to a longitudinal direction of the fixed section.

2. The waterproof connector according to claim 1, wherein the barrier surface of the waterproof shaped section has a height difference of not less than 0.01 mm.

3. The waterproof connector according to claim 1, wherein the barrier surface of the waterproof shaped section is formed of a planar surface, a curved surface, or a combination of a planar surface and a curved surface.

4. The waterproof connector according to claim 1, wherein the at least one conductive member comprises one or more contacts, and wherein the connector connecting section is a contact section that comes into contact with a contact of the counter connector.

5. The waterproof connector according to claim 1, wherein the at least one conductive member comprises a shell, wherein the connector connecting section is a fitted section to be fitted with the counter connector, wherein the fixed section includes a shell narrow section formed to be narrower than the connector connecting section, and wherein the waterproof shaped section is formed at a surface of the shell narrow section.

6. The waterproof connector according to claim 1, wherein the at least one conductive member comprises a shell, wherein the connector connecting section is a fitted section to be fitted with the counter connector, wherein the fixed section has a hollow shape, and wherein the waterproof shaped section is formed at each of an outer peripheral surface and an inner peripheral surface of the fixed section.

7. The waterproof connector according to claim 1, wherein the at least one conductive member comprises a shell and one or more contacts, and wherein the waterproof shaped section is formed at each of the shell and the one or more contacts.

8. A waterproof connector comprising:

a housing made of an insulating resin; and at least one conductive member formed integrally with the housing, wherein the at least one conductive member has a connector connecting section exposed from the housing and connected to a counter connector, a board connecting section exposed from the housing and connected to a board, and a fixed section connecting the connector connecting section and the board connecting section and embedded in the housing, wherein a waterproof shaped section for blocking entry of water along an interface between the fixed section and the housing is formed at a surface of the fixed section, wherein the waterproof shaped section has a protrusion that protrudes outwardly from the surface of the fixed section and a groove that is adjacent to the protrusion and is dented inwardly from the surface of the fixed section, with a top of the protrusion and a bottom of the groove adjacent to the protrusion being connected by a barrier surface inclined or perpendicular to the surface of the fixed section, wherein the at least one conductive member comprises a shell, wherein the connector connecting section is a fitted section to be fitted with the counter connector, wherein the fixed section has a hollow shape, and wherein the waterproof shaped section is formed at each of an outer peripheral surface and an inner peripheral surface of the fixed section.

9. A waterproof connector comprising:

a housing made of an insulating resin; and at least one conductive member formed integrally with the housing, wherein the at least one conductive member has a connector connecting section exposed from the housing and connected to a counter connector, a board connecting section exposed from the housing and connected to a board, and a fixed section connecting the connector connecting section and the board connecting section and embedded in the housing, wherein a waterproof shaped section for blocking entry of water along an interface between the fixed section and the housing is formed at a surface of the fixed section, wherein the waterproof shaped section has a protrusion that protrudes outwardly from the surface of the fixed section and a groove that is adjacent to the protrusion and is dented inwardly from the surface of the fixed section, with a top of the protrusion and a bottom of the groove adjacent to the protrusion being connected by a barrier surface inclined or perpendicular to the surface of the fixed section, wherein the at least one conductive member comprises a shell and one or more contacts, and wherein the waterproof shaped section is formed at each of the shell and the one or more contacts.

* * * * *